US011162648B2

(12) United States Patent
Rojas et al.

(10) Patent No.: US 11,162,648 B2
(45) Date of Patent: Nov. 2, 2021

(54) MULTIFUNCTIONAL FLASHLIGHT WITH DOUBLE LAMP ROTATING BASE

(71) Applicants: Diogenes Patrick Rojas, Chicago, IL (US); Lauren Suzanne Rojas Castillo, Chicago, IL (US); Ivan Emilio Bournigal Guzmán, Santiago (DO)

(72) Inventors: Diogenes Patrick Rojas, Chicago, IL (US); Lauren Suzanne Rojas Castillo, Chicago, IL (US); Ivan Emilio Bournigal Guzmán, Santiago (DO)

( * ) Notice: Subject to any disclaimer, the term of this patent is extended or adjusted under 35 U.S.C. 154(b) by 0 days.

(21) Appl. No.: 16/799,875

(22) Filed: Feb. 25, 2020

(65) Prior Publication Data

US 2021/0180756 A1 Jun. 17, 2021

Related U.S. Application Data

(60) Provisional application No. 62/811,549, filed on Feb. 28, 2019.

(51) Int. Cl.

| | |
|---|---|
| ***F21L 4/04*** | (2006.01) |
| ***F21V 23/00*** | (2015.01) |
| ***F21V 23/04*** | (2006.01) |
| ***F21V 23/06*** | (2006.01) |
| ***F21V 21/08*** | (2006.01) |
| ***F21Y 115/10*** | (2016.01) |

(52) U.S. Cl.

CPC ..... *F21L 4/045* (2013.01); *F21V 21/08* (2013.01); *F21V 23/002* (2013.01); *F21V 23/003* (2013.01); *F21V 23/04* (2013.01); *F21V 23/06* (2013.01); *F21Y 2115/10* (2016.08)

(58) Field of Classification Search

CPC ... F21L 4/045; F21L 4/04; F21L 4/027; F21V 21/30; F21V 21/40; F21V 21/405

See application file for complete search history.

(56) References Cited

U.S. PATENT DOCUMENTS

| | | | | |
|---|---|---|---|---|
| 9,568,175 | B2 * | 2/2017 | Johnson | F21L 4/04 |
| 10,001,252 | B2 * | 6/2018 | Inskeep | H05B 45/00 |
| 2006/0034074 | A1 * | 2/2006 | Ko | F21V 23/0414 362/184 |
| 2012/0182723 | A1 * | 7/2012 | Sharrah | F21L 4/005 362/157 |
| 2013/0128565 | A1 * | 5/2013 | Cugini | F21L 4/02 362/184 |
| 2017/0284646 | A1 * | 10/2017 | Arena | F21V 23/0442 |

* cited by examiner

*Primary Examiner* — William N Harris

(57) ABSTRACT

A flashlight is disclosed which comprises a base that has a servo motor that allows the base to rotate in a 180° angle, and at each end of said base lamps are placed with a plurality of LED lights, a main support which has a battery indicator, a camera and an LCD or LED screen, some buttons that control the on, off, flashing lights and camera, also on said main support is placed a removable SD memory that allows data storage, said flashlight also comprises a handle that has buttons that serve to control the LED lights of the lamps, and a switch to control the rotating base, said flashlight also comprises a removable battery responsible for supplying the power of the entire system of that flashlight.

4 Claims, 12 Drawing Sheets

MULTIFUNCTIONAL FLASHLIGHT WITH DOUBLE LAMP ROTATING BASE

FIELD OF THE INVENTION

The present invention relates to a flashlight, and more particularly, to a portable flashlight that has a rotating base where removable lamps with a plurality of LED lights are placed, said flashlight also has a camera and an LCD or LED screen.

BACKGROUND

Those responsible for directing traffic, have flashlights, light sticks or their hands to direct traffic, however, we have observed the chaos that is formed when traffic authorities try to control and organize vehicular traffic and crosswalk in peak hours, and when large events are held or held in recreation centers and shows, and large sporting events with large crowds when they finish that activity. The problem is also repeated in educational centers at the time when parents are leaving and picking up children in schools. Another similar situation is repeated when traffic accidents occur.

One of the problems we see with the lanterns they use for traffic is that they have only one screen of lights where they can only point in one direction at a time, in case of using it as a flashlight, but if it is used to indicate an order to the pedestrians or drivers would not be advisable since the light could be intense and pointing straight ahead the signal could not be seen; and if a rigid cone is placed on said flashlight to turn it into a luminous baton, the person in charge of controlling traffic would have to make a series of maneuvers that depending on the angle in which the luminous baton is located, it may happen that the signals cannot be see, or be confusing for pedestrians or drivers, and this is one of the reasons why the person in charge of traffic is obliged to repeat the maneuver, and in some cases they have to shout at pedestrians or drivers indicating what should they do. Also the flashlight that is placed on the rigid cone, could only be one function at a time, that is, it can only be a flashlight or light stick and not both at the same time.

Another problem that people in charge of traffic could face is that flashlights or flashlights do not have the ability to emit different types of lights at different angles at the same time, that is, they cannot send signals with different orders at the same time at an angle different.

Another problem is that people in charge of traffic must be in very good physical shape; if the person has a type of lesson that prevents him from moving in certain postures, mainly with his hands, he will not be able to do his job correctly and this could cause a more serious lesson, where the person in charge of traffic is obliged to have to abandon your mission.

Other problems are that people in charge of traffic do not necessarily have cameras to record the event while exercising their functions.

The lack of mechanisms that allow better communication between traffickers, pedestrians and drivers can cause traffic jams or accidents that can put the lives of people in the area at risk, be it pedestrians or drivers, including the person in charge of traffic.

DISCLOSURE OF THE INVENTION

The present invention relates to a flashlight comprising a main support where said support has a servo motor from which a rotating base is grasped and at each end of said rotating base detachable lamps are placed having a plurality of LED lights. Said main support also has several buttons, such as the on/off switch for the front lamp, flashing light switch for the front lamp, on/off switch for the rear lamp, light switch flashing for the rear lamp, in this way the operator can choose to use a lamp or two lamps at the same time, you can also place a single lamp with flashing lights or the two lamps with flashing lights, also said support Main has a switch to activate and deactivate the camera, a battery indicator and a potentiometer to control the rotation of the rotating base.

The main stand also has a camera and a screen that can be LCD or LED to visualize what the camera focuses on; The screen is attached to a rotating support that allows the screen to be moved in different positions and can be stored, so that the screen rotates in conjunction with the rotating support until it is placed under the main support of the flashlight. Also in said main support is placed a removable SD memory that is protected by a protective cover, also in said main support is a microphone, which serves to capture the external sound.

On the back of the lamps with LED lights they have hooks that are used to be placed inside brackets to hold the hooks, these brackets are fixed at each end of the rotating base. By placing the lamp hooks with LED lights on the brackets to hold the hook, the LED lamp lamps are fully fixed.

Also the back of the lamps with lights have a female connector where one of the ends of a cable that has a male connector is placed and at the other end of said cable that has another male connector is connected to a female connector that It is located in the swivel base, where the female connector of said swivel base is connected to the controller card. In addition, LED light lamps have indicators with LED lights that are used to indicate to the operator what color of light these light lamps are active.

The flashlight also comprises a handle that is held by the main support and that has a panel with buttons placed on the side of said handle such that said panel has a slight inclination that facilitates the reach of the thumb to operate the buttons. said panel. You can use your thumb to operate the panel, holding the grip firmly with the other fingers of your hands; said panel is used to control the change in the color of the lamp lights.

The handle also has a trigger or switch that, when pressed, the rotating base rotates at a horizontal angle at 180° degrees, placing one of the LED lamp lamps in front and the other LED lamp in the back position to said front lamp in this way, people who are in front or on the back side of the flashlight operator can see the warning or call that is being issued, or simply illuminate the area on both sides.

The flashlight has a removable rechargeable battery that powers the entire system; If the flashlight is running out of charge, you can replace the battery with one that is charged and continue to operate the flashlight without problems.

The flashlight has a grip that serves to hold a strap where you can use it as a belt that is placed on the shoulder, it can also be placed on any surface or object that protrudes.

The present invention with its features and advantages are readily apparent from the following detailed description of the best way to carry out the invention when taken in connection with the accompanying drawings.

DETAILED DESCRIPTION OF THE PREFERRED EMBODIMENT

Figure 1:
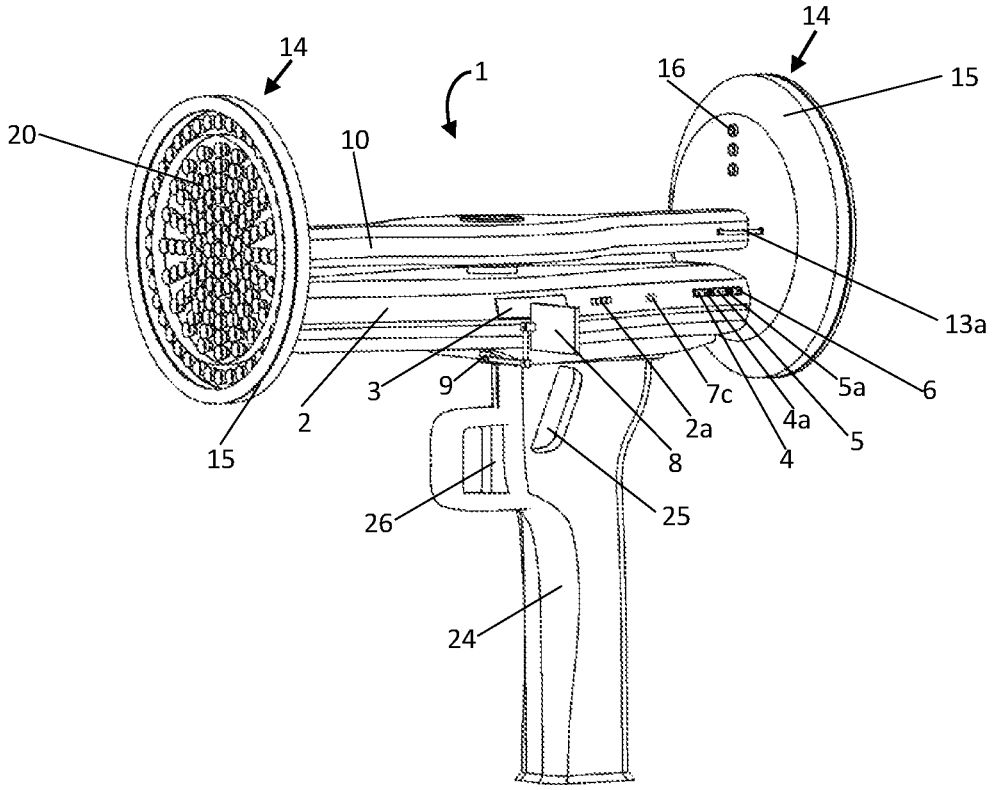
FIG. 1. Shows a perspective view of the left side of the present invention with some parts identified.

FIG. 1 shows a flashlight (1) comprising a rotating base (10) where said rotating base (10), has two LED lamps (14) one at each end where said LED lamp (14) receives energy by means of a cable (13*a*) that goes from the rear cover (15) of the LED lamp (14) to the rotating base (10). The rear covers (15) of the LED lamp (14) have LED indicator lights (16) that allow the operator to indicate the color of the LED lights (20) that are operating in the LED lamp (14).

FIG. 1 of said flashlight (1) also comprises a main support (2) that has several buttons that are: The on/off switch of the front lamp (4), flashing light switch of the front lamp (4*a*), the rear lamp on/off switch (5), rear lamp turn signal switch (5*a*), MINI DVR on/off switch 6, a battery indicator (2*a*), a potentiometer (7*c*), a grab hook (3), an LCD or LED monitor (8) that is held by arms (9*a*).

FIG. 1 of said flashlight also comprises a handle (24) that has a button panel (25) that allows changing the colors of the LED lights (20) and the LED indicator lights (16), a switch or trigger (26) that pressing it allows the rotating base to rotate.

Figure 2:
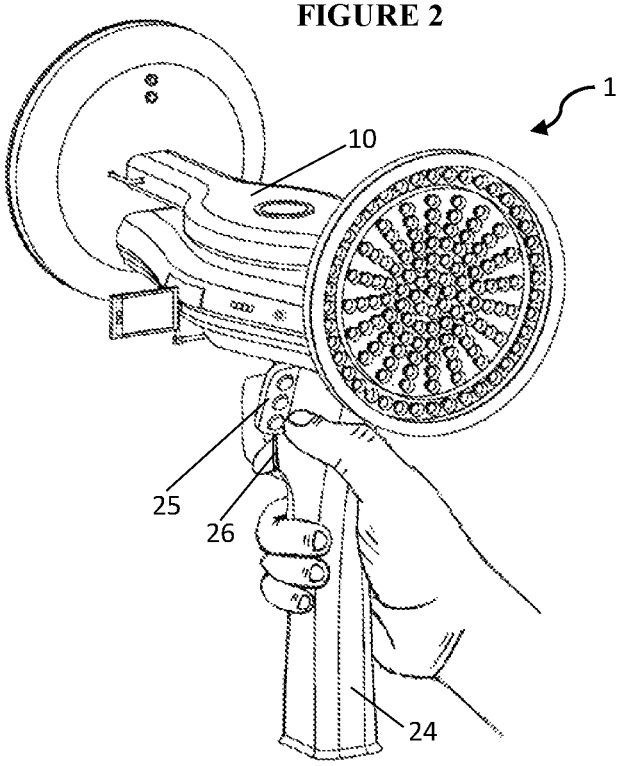
FIG. 2. Shows a perspective view of the back of the present invention with some parts identified, where a hand is seen gripping the handle.

As shown in FIG. 2, the lantern handle (24) is held in one hand, where the thumb of said hand is in position to press one of the panel buttons (25), while the finger Index is in position to press the switch (26) and the other fingers are holding the handle (24). Said panel (25) is attached to the side of the handle (24) and has a slight inclination such that the thumb can easily reach and accommodate the panel buttons (25), and at the same time the index finger can be used to press the switch (26) that allows the rotation of the rotating base (10).

Figure 3:
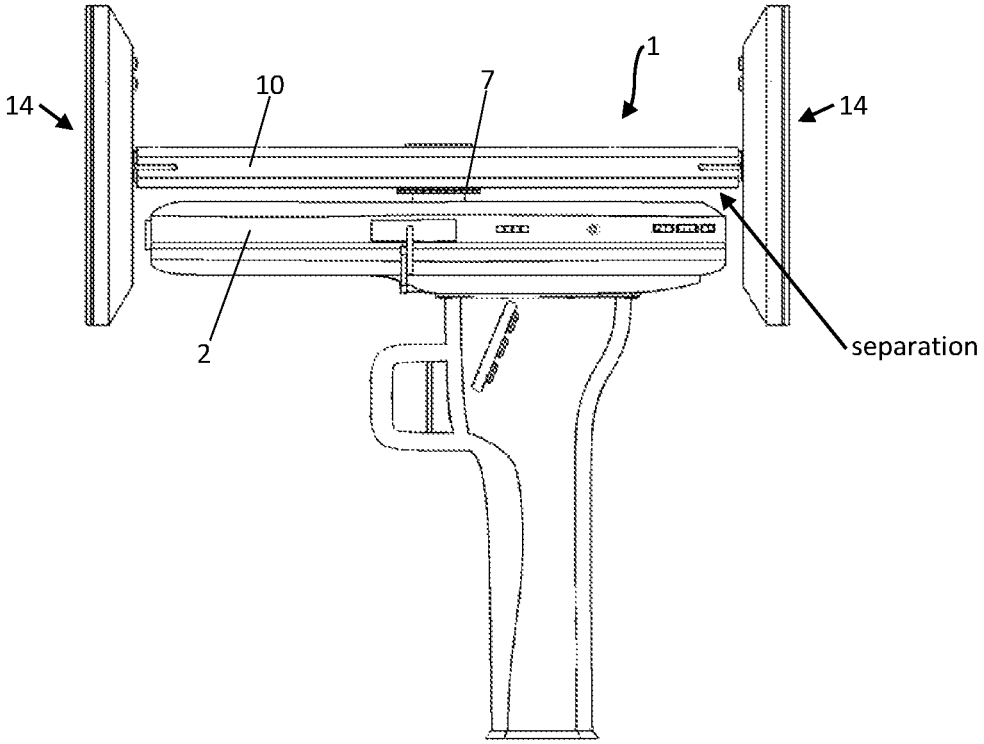
FIG. 3. Shows a left side view of the present invention with some parts identified.

FIG. 3 shows a flashlight (1) where the main support (2) is connected to the rotating base through the pinion of the servo motor (7), leaving a gap between the medium so that when you rotate the rotating base (10) do not have any contact with the main support (2), also the LED lights lamps (14) are placed at each end of the rotating base (10) in such a way that it does not make contact with the main support (2), so The rotating base (10) together with the LED lamp lamps (14) can rotate freely.

Figure 4:
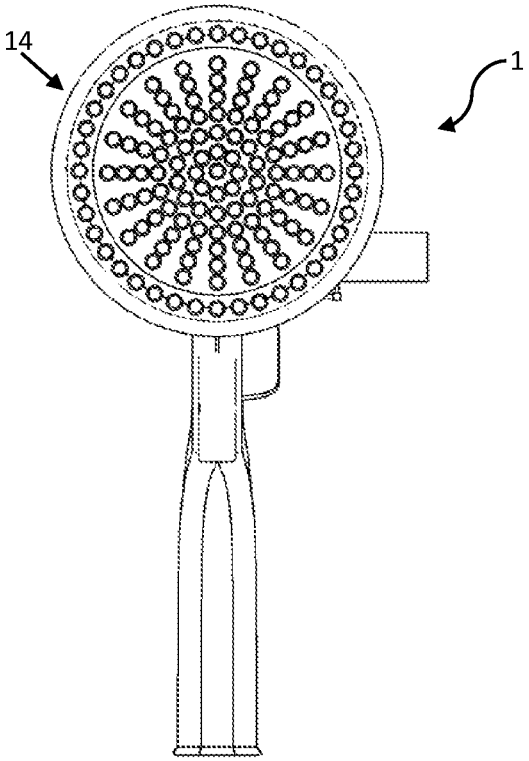
FIG. 4. Shows a front view of the present invention with some parts identified.
Figure 5:
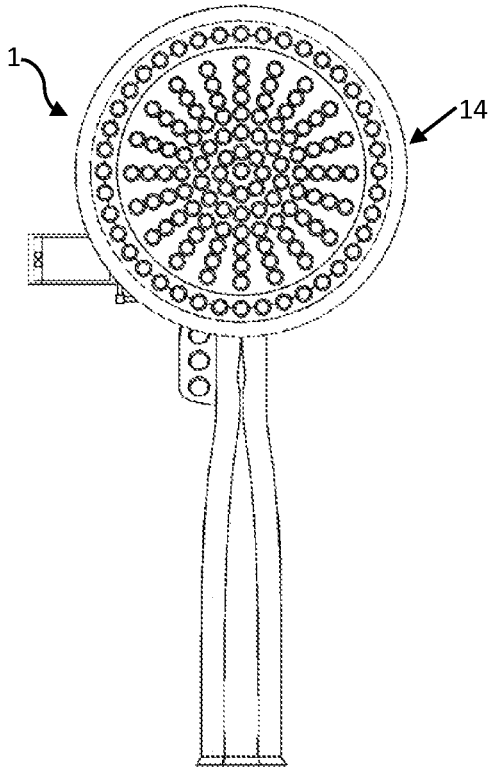
FIG. 5. Shows a rear view of the present invention with some parts identified.

FIGS. 4 and 5 shows a flashlight (1) where the front and rear LED lamp lamps (14) can be identified, said LED lamp lamps (14) preferably have an approximate size of 17 cm in diameter, being a suitable size for when the person in charge of the traffic points on the pedestrians and drivers can see the LED lights clearly.

Figure 6:
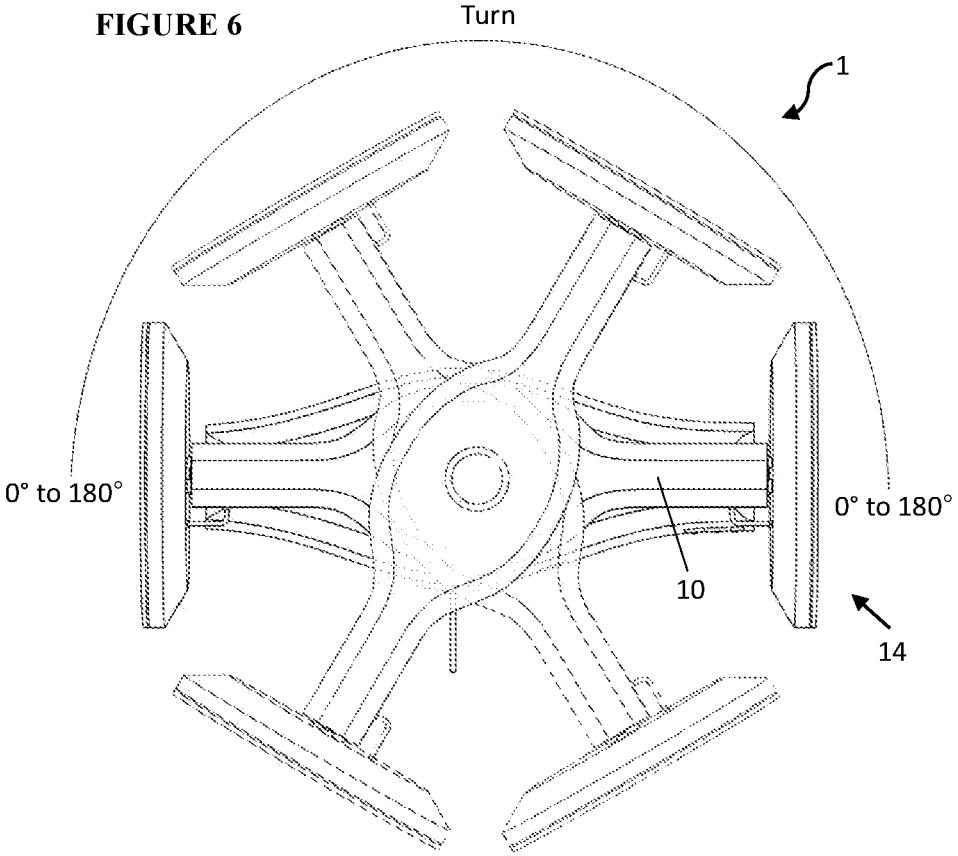
FIG. 6. Shows a top view of the present invention where the rotating base is simulating a 180° rotation.

FIG. 6 shows a simulation of the rotating base (10) together with the LED lamp lamps (14) of the flashlight (1) rotating from an initial position to which we set as 0° degrees to 180° degrees, such so that the front LED lamp (14) is on the back of the flashlight (1) and the rear LED lamp (14) is on the front and vice versa. In this way an order can be issued with the front LED lamp (14) towards the pedestrians or drivers who are obviously in front and with the other rear LED lamp (14) another different order can be issued towards the pedestrians or drivers that are obviously in the back, and you can quickly change the order by turning the rotating base (10) where the order executed with the front LED lamp (14) is on the back of the flashlight (1) and the order of the rear LED lamp (14) is on the front. In other words, you can send different orders at different angles at the same time, also quickly change an order that is being executed to the front and place that order on the back and vice versa.

Figure 7:
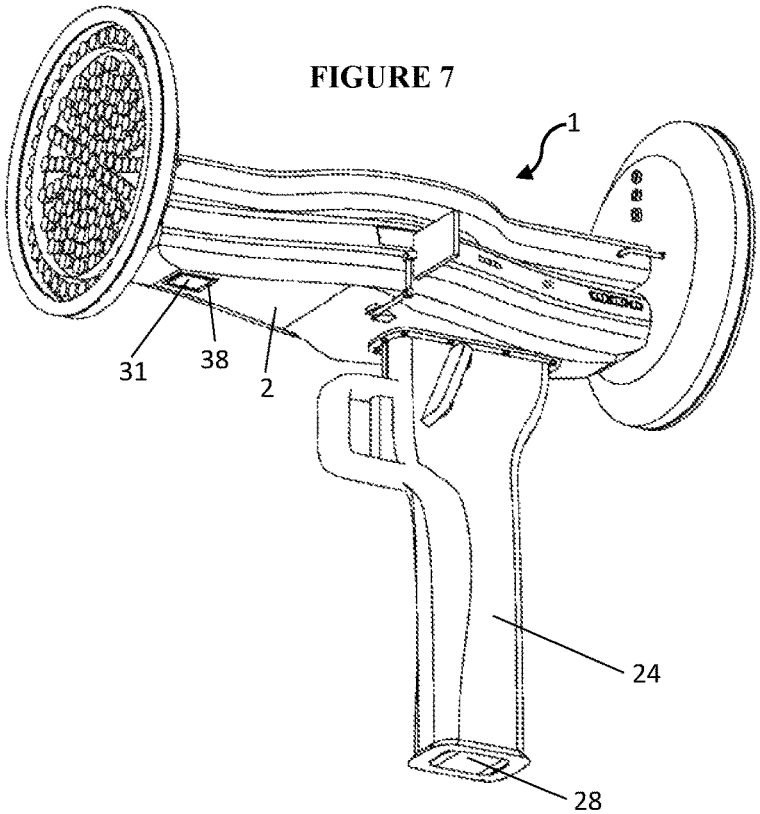
FIG. 7. Shows a bottom perspective view of the present invention with some parts identified.

As shown in FIG. 7, the flashlight (1) has a protective cover (31) that has an audio output for the microphone (38), which is already placed in its corresponding place on the main support (2). Also the handle of said flashlight (1) has a cover to protect the battery (28), where said cover is placed in its corresponding place.

Figure 8:
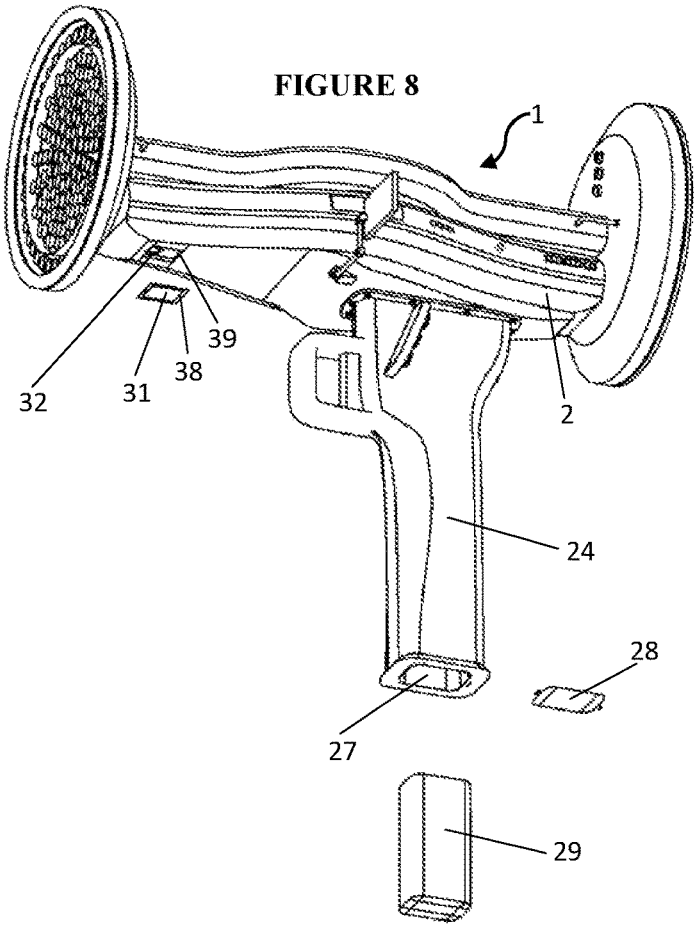
FIG. 8. Shows a bottom perspective view of the present invention where the protective cover of the SD card containing the orifice of the microphone outlet and the protective cover of the battery is out of place, the input of the battery, with said battery out of place.

As shown in FIG. 8, the flashlight (1) has the protective cover of the SD memory (31) removed, so that it allows the SD memory to be placed or removed from its place. Also the handle (24) of said flashlight (1) has the protective battery cover (28) and the battery (29) removed; the battery input (27) can be distinguished where said input (27) and the internal part of said input (27) has the shape of the battery (29), also said input (27) is slightly larger than the battery (29), so that the battery (29) can enter, and when placed it can be perfectly adjusted, so that it cannot move from its place regardless of whether they make sudden movements with the flashlight (1).

Figure 9:
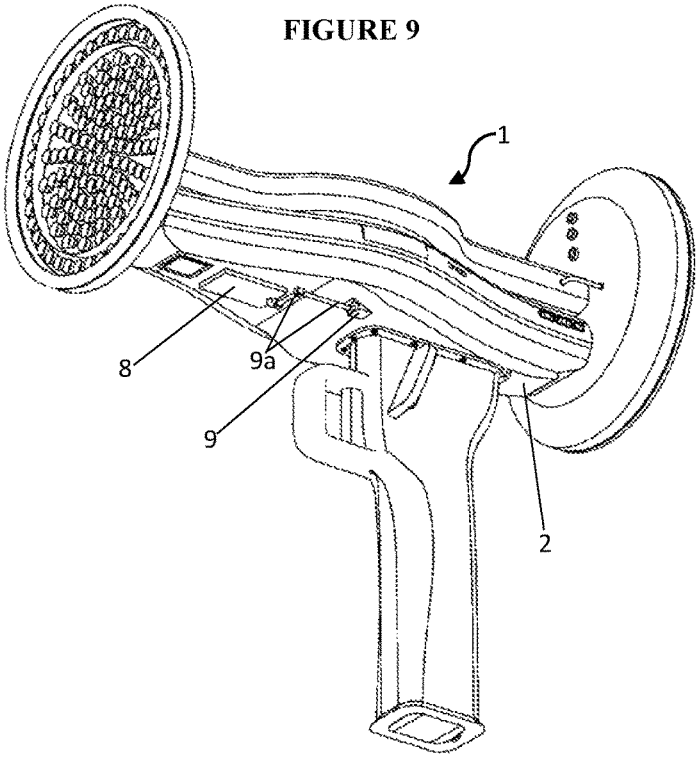
FIG. 9. Shows a bottom perspective view of the present invention where the LCD or LED screen in conjunction with the rotating stand are placed in saved mode.

As shown in FIG. 9, the rotating support (9) is attached to the main support (2) of the flashlight (1), and the arms (9*a*) have two ends, the first of the ends is attached to said rotating support (9) and the second end of said arms (9*a*) is holding the LCD or LED screen (8). The arms (9*a*) can be moved or rotated in such a way that the LCD or LED screen (8) can be placed in the lower part of the main support (2) and in this way said LCD or LED screen (8) is protected. In the position in which the LCD or LED screen (8) is located in FIG. 9 we call it the storage position.

Figure 10:
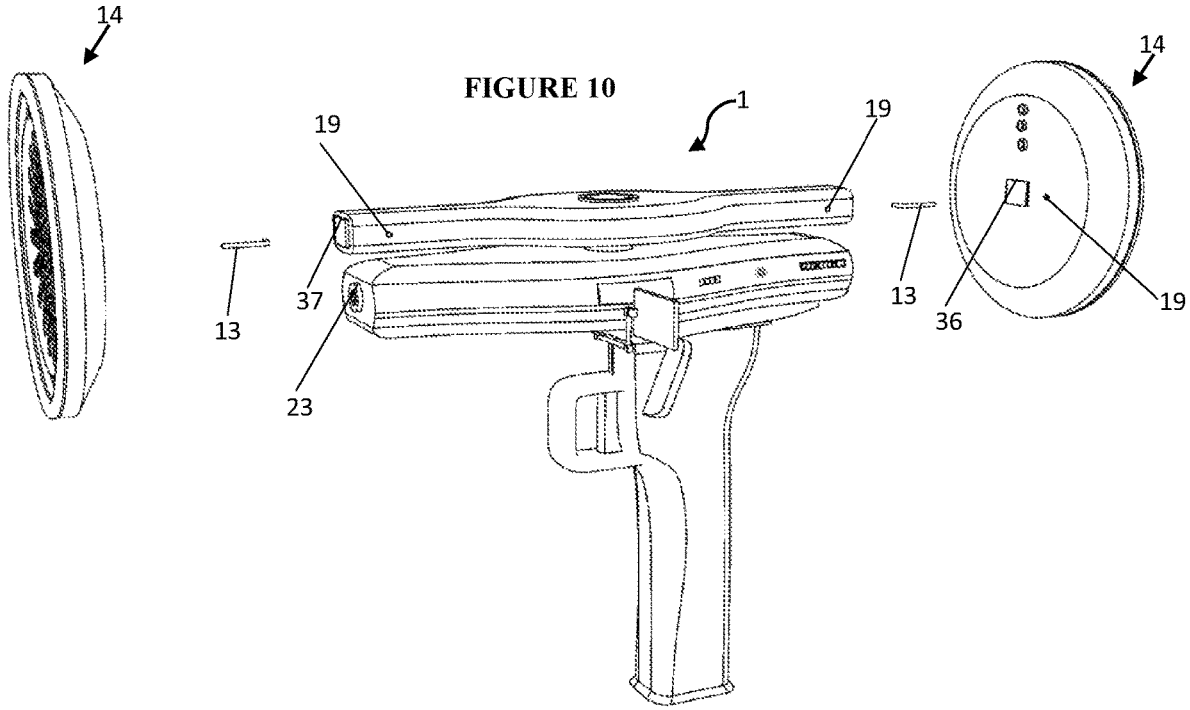
FIG. 10. Shows a left side perspective view with the LED lamps removed.

As shown in FIG. 10, the flashlight (1) has the LED light lamps (14) removed and the cables with the male connectors (13) removed. The entrance of the female connectors (19) where one of the ends of said cables with male connectors (13) and on the back of said LED lamps (14) can be identified on the rotating base (10). the input of a female connector (19) can be identified where the other end of said cables is connected with male connectors (13). The way to remove the LED lamp lamps (14) from the rotating base (10) is to first remove the cables with the male connectors (13) from the female connectors (19), and then press the grip hook (36) of the support to hold the hook (37).

Figure 11:
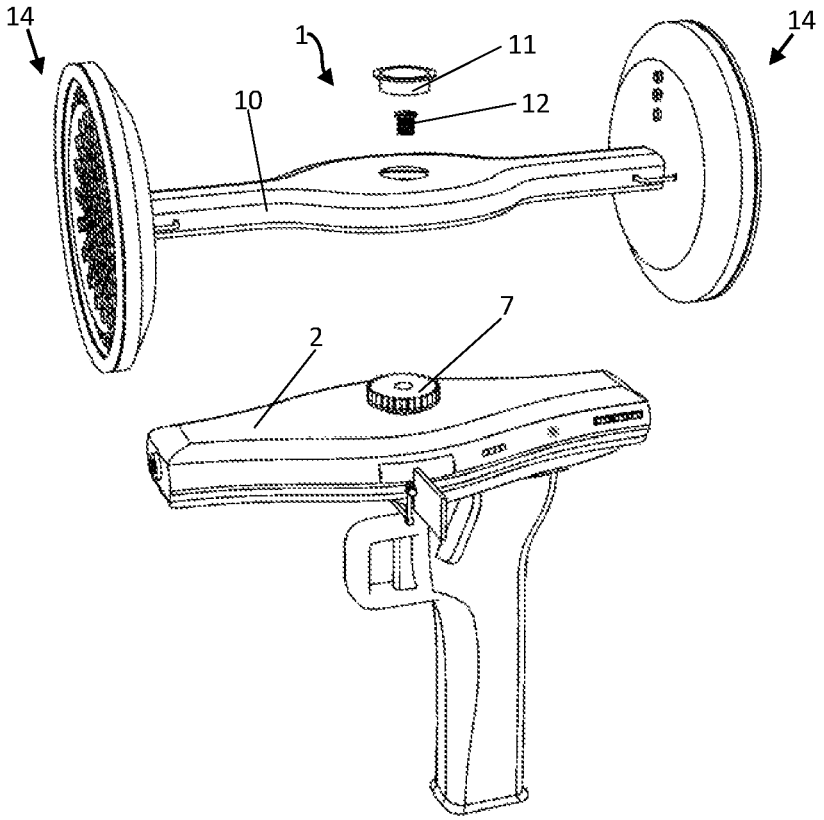
FIG. 11. Shows a perspective view of the left side of the present invention with the LED lamp lamps mounted on the rotating base and said disassembled rotating base.
Figure 12:
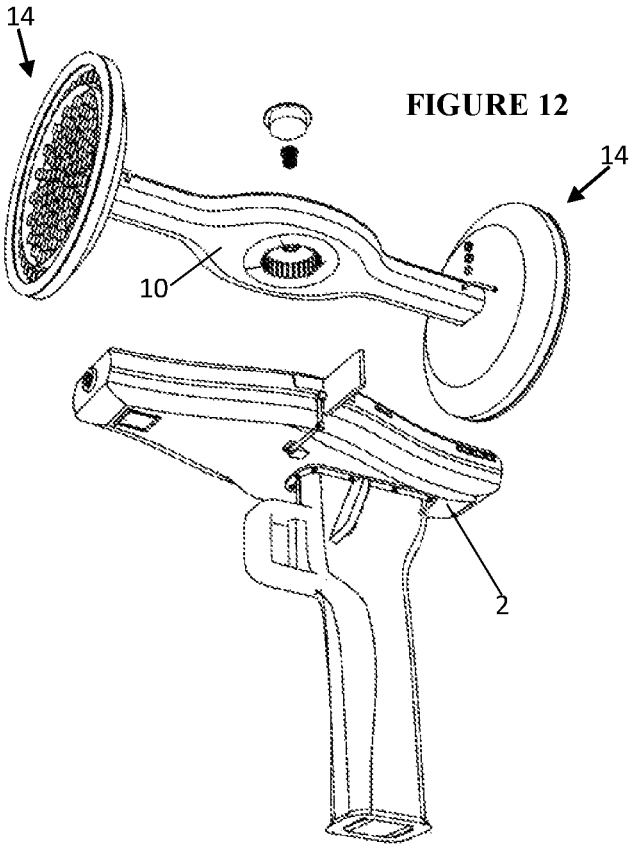
FIG. 12. Shows a bottom perspective view of the left side of the present invention with the LED lamp lamps mounted on the swivel base and said swivel base disassembled.

As shown in FIGS. 11 and 12, the rotating base (10) is removed from the flashlight (1). The rotating base (10) of the lantern (1) is disassembled in such a way that you only have to remove the protective cap (11) with outward pressure, then unscrew the screw (12) which is what allows the base to be fixed rotating (10) of the servo motor pinion (7). The rotating base (10) in the lower part has a groove with grooves that fit with the pinion of the servo motor (7) such that said pinion (7) is perfectly positioned inside the groove with splines of said rotating base (10). By placing the pinion (7) inside the rotating base (10) in its corresponding place, it allows said rotating base (10) to rotate firmly.

Figure 13:
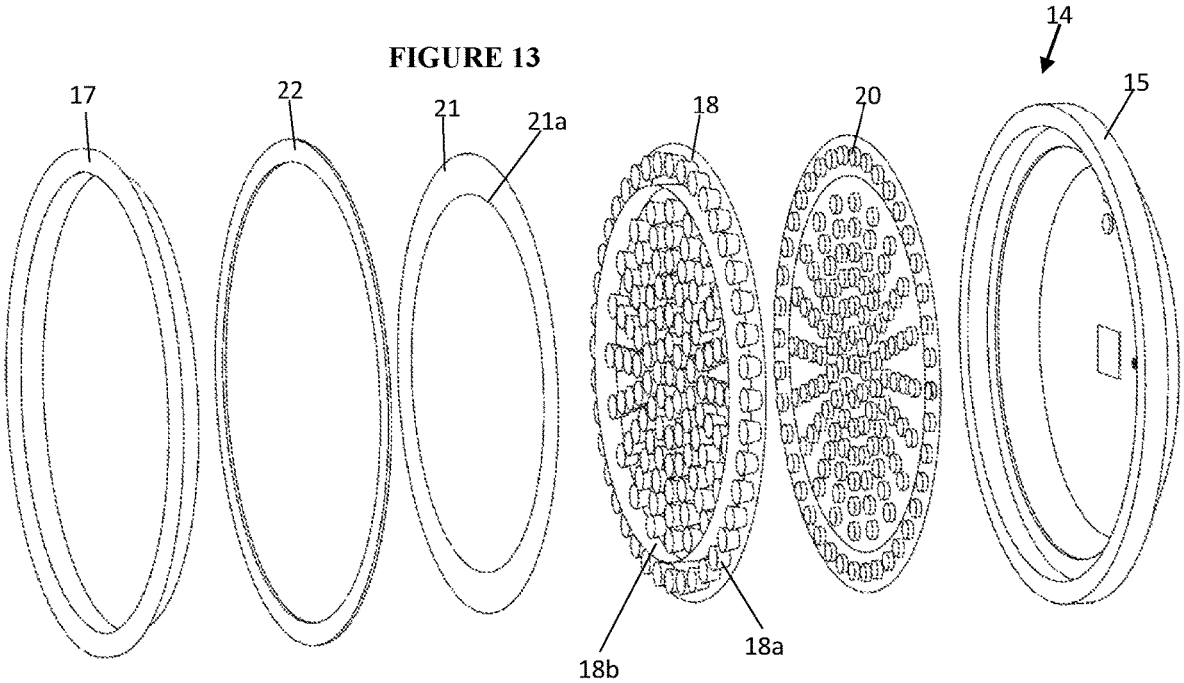
FIG. 13. Shows a perspective view of the left side of one of the disassembled LED lamps with most of its parts identified.

As shown in FIG. 13, the LED light lamp (14) has a rear cover (15), which will protect the LED light matrix (20) when placed on the inside of said rear cover (15), It also has a reflector base (18) that is placed in such a way that the LED lights (20) remain inside the inverted cones (18*a*) of said reflector base (18). Said cones (18*a*) function as a light collector, broadening the reflection of the emitted light, also each of the LED lights (20) within said cone (18*a*) are separated, so that, with all the LEDs on its light can be identified individually, also said reflector base (18) has a division (18*b*) that allows LED lights (20) to be separated from other LED lights (20), that is, a group of LED lights (20) can emit lights without mixing with the emitted lights of the other group of LED lights (20). Also the inverted cones (18*a*) and the division (18*b*) have the same length size which allows to create a flat surface in the front part of said reflecting base (18) such that the lens (21) can be placed on the front part of the reflector base (18) said lens (21) being perfectly positioned.

The lens (21) of FIG. 13 has a division (21*a*) that coincides with the division (18*b*) of the reflecting base (18) where the central part of said lens (21) can have different colors or be translucent, and the other part of said lens (21) can be of another color or be translucent, in this way people can see different shades of colors in the lens (21) at the same time or simply directly see the LED lights (20).

The LED lamp (14) of FIG. 13 also has a rubber gasket (22) that is placed on the back of the front protective cover (17) where said front protective cover (17) with the rubber gasket (22) comes under pressure, and is sealed from the front part of the back cover (15), in this way all the parts that remain inside said back cover (15) are fully protected, and where said rubber gasket (22) creates a shield so that no type of particle penetrates into said LED lamp (14).

Figure 14:
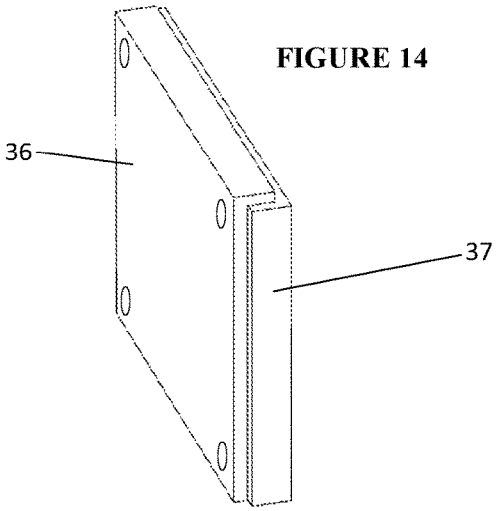
FIG. 14. Shows a top perspective view of the grip hook attached to the support for holding the hook.

In FIG. 14 it shows a hook (36) attached to the support (37) where the leg that is inside the hollow of said support (37) has a size practically equal to that of the hollow of said support (37), the pressure exerted and The firmness with which said hook (36) is grasped within the hollow of said support (37) prevents said hook (36) from moving from its position or from exiting.

Figure 15:
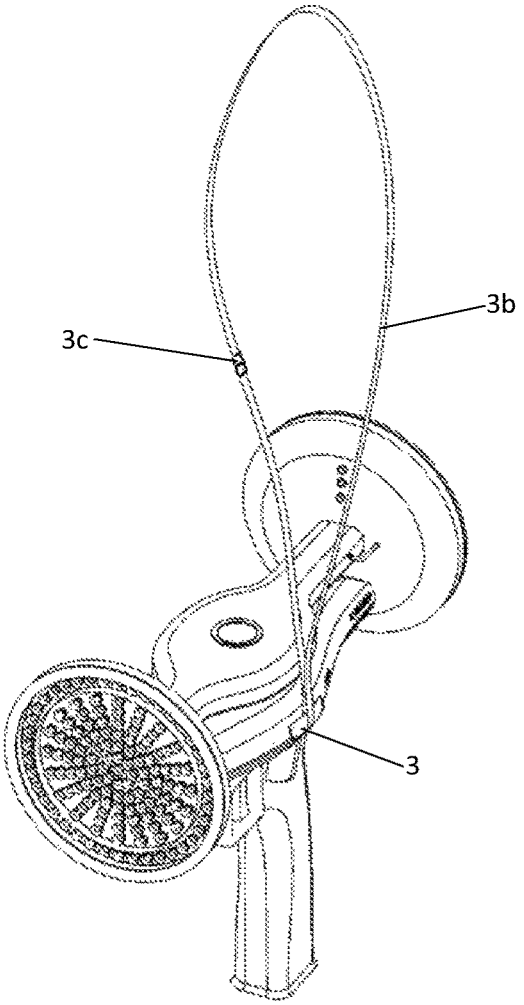
FIG. 15. Shows a perspective view of the left side of the flashlight with a strap attached to the grip.

FIG. 15 shows an illustration of the flashlight with a strap (3*b*) placed on the grip (3), where said strap (3*b*) has an automatic pressure buckle (3*c*), which when pressed releases said strap (3) to be able to remove it from the grip (3).

Figure 16:
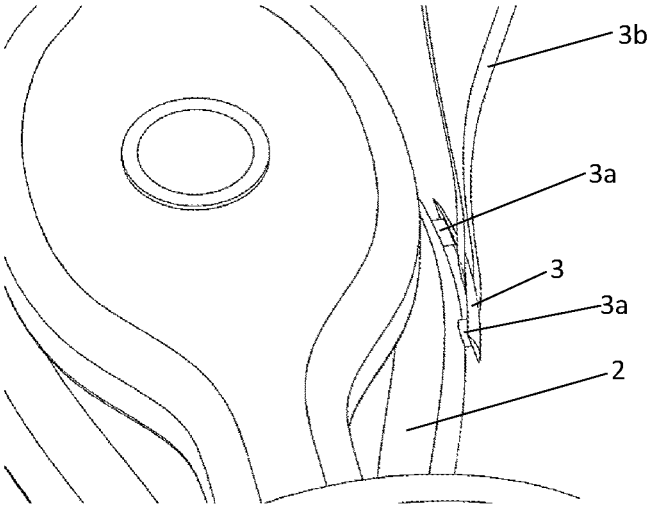
FIG. 16. Shows a top perspective view of the gripping part fixed to the main support and with a strap attached.

FIG. 16 shows an illustration where you can see the inside of the grip piece (3) where said piece (3) has two supports (3*a*), one at each end, which are attached to the main support (2), and said supports (3*a*) of the grip piece is approximately 8 mm long, and being fixed of the main support (2) leaves a space between said main support (2) and the grip piece (3), by said space is where the strap enters (3*b*).

Figure 17:
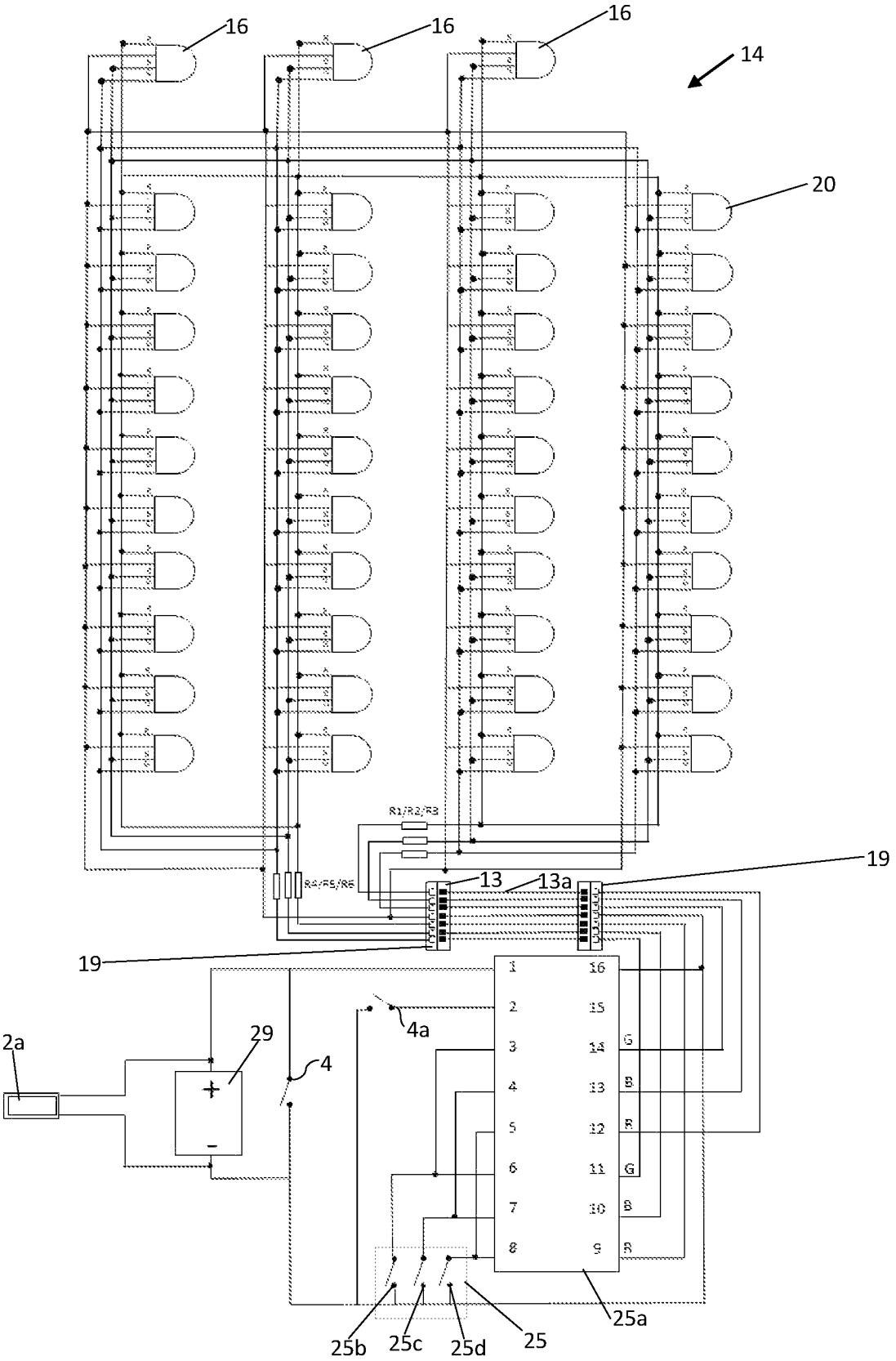
FIG. 17. It is a schematic diagram of a control circuit of the LED headlight array connected to a controller card.

FIG. 17 shows an illustration of a schematic diagram of the control circuit of the LED lights (20) and the LED indicator lights (16) of the front lamp (14), where said LEDs are crystal RGB, and common cathode. The anodes of these LEDs have a limiting resistance to protect them. Said LEDs (20) and LED indicator lights (16) are connected in such a way that the anodes of the red LEDs are connected consecutively in series, with the anode assemblies of said red LEDs connected in parallel, like that the anodes of the blue LEDs that are connected consecutively in series, with the anode assemblies of the said blue LEDs connected in parallel and the anodes of the green LEDs are connected consecutively in series, with the sets of the anodes of said green LEDs connected in parallel, where said RGB LEDs form a matrix. The wiring end of said array of LED lights (20) is attached to a female connector (19) and said female connector (19) has a male connector (13) connected and said male connector are attached cables (13*a*) and in at the other end of said cables (13*a*) is another male connector (13) connected to a female connector (19) where the cables that communicate with the controller card (25*a*) are connected. Said controller card is housed inside the flashlight (1).

The controller card (25*a*) has pins that are listed in such a way that:

Pin 1 or VDD communicates with the positive of the battery (29), and with one of the poles of the on/off switch (4), and the other pole of said switch (4) is connected to pin 16 or VSS of the controller card (25*a*). The function of the switch (4) is to turn the front LED lamp (14) on and off.

Pin 2 communicates with a switch (4*a*) and the other pole of said switch (4*a*) communicates with pin 16 or VSS of the controller card (25*a*). The function of the switch (4*a*) is to activate the LED lights (20) intermittently.

Pin 3 communicates with pin 14, pin 6 and pin 11, where said pins communicate with one of the switch's poles (25*b*) of the panel (25) and the other pole of said switch (25*b*) is connected to pin 16 or VSS of the controller card (25*a*). The function of said switch (25*b*) of the panel (25) is to activate or deactivate one of the colors of the LED lamp (14).

Pin 4 communicates with pin 13, pin 7 and pin 10, where said pins communicate with one of the switch's poles (25*c*) of the panel (25) and the other pole of said switch (25*c*) is connected to pin 16 or VSS of the controller card (25*a*). The function of said switch (25*c*) of the panel (25) is to activate or deactivate one of the colors of the LED lamp (14).

Pin 5 communicates with pin 12, pin 8 and pin 9, where said pins communicate with one of the switch's poles (25*d*) of the panel (25) and the other pole of said switch (25*d*) is connected to pin 16 or VSS of the controller card (25*a*). The function of said switch (25*c*) of the panel (25) is to activate or deactivate one of the colors of the LED lamp (14).

Pin 16 or VSS communicates with the negative pole of the battery (25). Said battery (25) has a battery indicator (2*a*), which is used to measure the amount of charge that said battery has (25).

The controller card (25*a*) is held in the inner part of the main support (2) in such a way that it cannot be moved. Said controller card (25*a*) being in the internal part of the support (2), is also protected.

Figure 18:
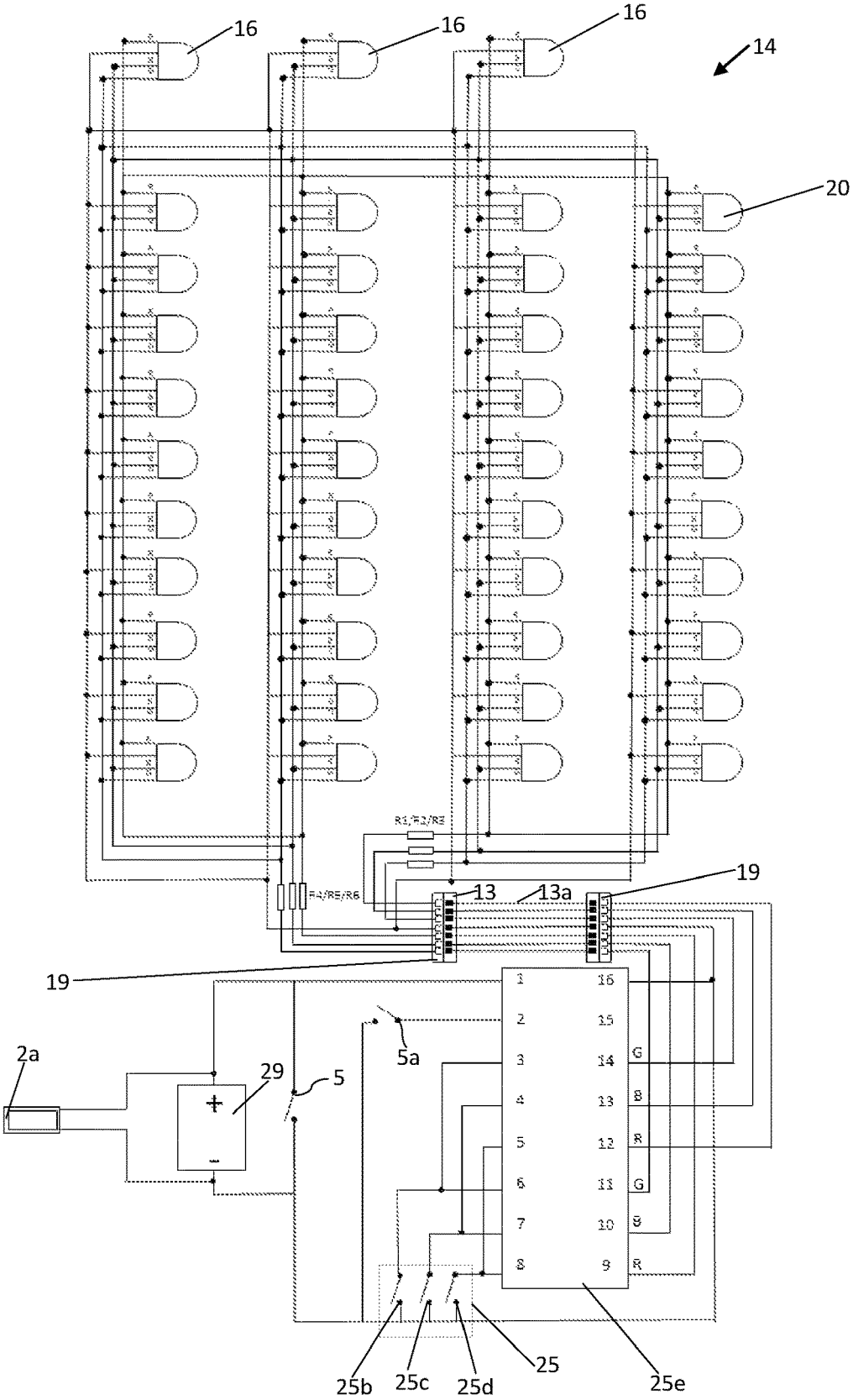
FIG. 18. Schematic diagram of the rear lamp.

FIG. 18 shows an illustration of a schematic diagram of the control circuit of the LED lights (20) and the LED indicator lights (16) of the rear lamp (14), where said LEDs are RGB glass, common cathode. The anodes of these LEDs have a limiting resistance to protect them. Said LEDs (20) and LED indicator lights (16) are connected in such a way that the anodes of the red LEDs are connected consecutively in series, with the anode assemblies of said red LEDs connected in parallel, like that the anodes of the blue LEDs that are connected consecutively in series, with the anode assemblies of the said blue LEDs connected in parallel and the anodes of the green LEDs are connected consecutively in series, with the sets of the anodes of said green LEDs connected in parallel, where said RGB LEDs form a matrix. The wiring end of said array of LED lights (20) is attached to a female connector (19) and said female connector (19) has a male connector (13) connected and said male connector are attached cables (13*a*) and in at the other end of said cables (13*a*) there is another male connector (13) connected to a female connector (19) where the cables that communicate with the controller card (25*e*) are connected. Said controller card (25*e*) is housed inside the flashlight (1).

The controller card (25*e*) has pins that are listed in such a way that:

Pin 1 or VDD communicates with the positive of the battery (29), and with one of the poles of the on/off switch (5), and the other pole of said switch (5) is connected to pin 16 or VSS of the controller card (25*e*). The function of the switch (5) is to turn the rear LED lamp (14) on and off.

Pin 2 communicates with a switch (5*a*) and the other pole of said switch (5*a*) communicates with pin 16 or VSS of the controller card (25*e*). The function of the switch (5*a*) is to activate the LED lights (20) intermittently.

Pin 3 communicates with pin 14, pin 6 and pin 11, where said pins communicate with one of the switch's poles (25*b*) of the panel (25) and the other pole of said switch (25*b*) is connected to pin 16 or VSS of the controller card (25*e*). The function of said switch (25*b*) of the panel (25) is to activate or deactivate one of the colors of the LED lamp (14).

Pin 4 communicates with pin 13, pin 7 and pin 10, where said pins communicate with one of the switch's poles (25*c*) of the panel (25) and the other pole of said switch (25*c*) is connected to pin 16 or VSS of the controller card (25*e*). The function of said switch (25*c*) of the panel (25) is to activate or deactivate one of the colors of the LED lamp (14).

Pin 5 communicates with pin 12, pin 8 and pin 9, where said pins communicate with one of the switch poles (25*d*) of the panel (25) and the other pole of said switch (25*d*) is connected to pin 16 or VSS of the controller card (25*e*). The function of said switch (25*d*) of the panel (25) is to activate or deactivate one of the colors of the LED lamp (14).

Pin 16 or VSS communicates with the negative pole of the battery (25). Said battery (25) has a battery indicator (2*a*), which is shown in FIG. 23, which serves to measure the amount of charge that said battery has (25).

The controller card (25*e*) is held in the inner part of the main support (2) in such a way that it cannot be moved. Said controller card (25*e*) being in the internal part of the support (2), is also protected.

Figure 19:
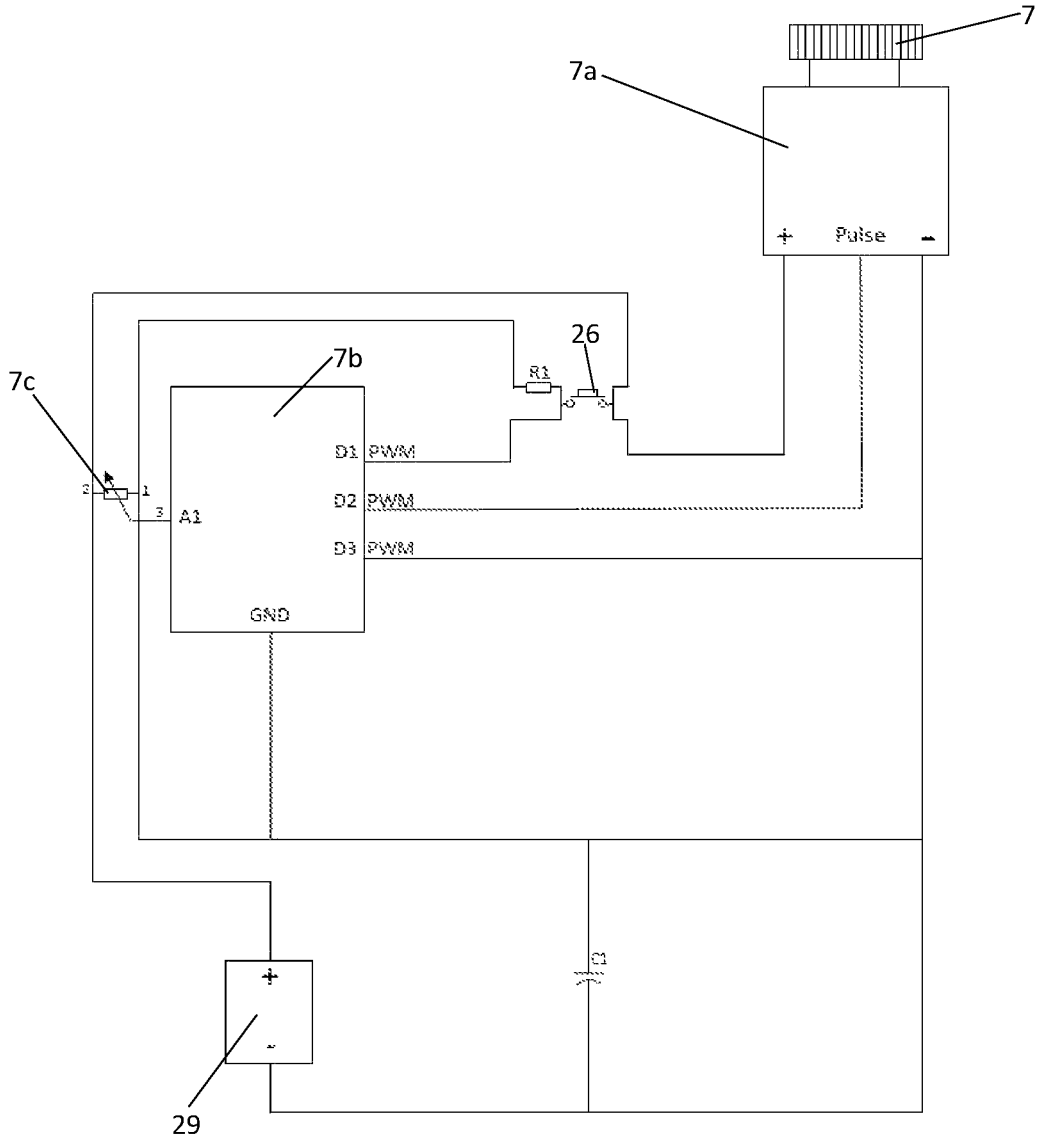
FIG. 19. Schematic diagram of the servo motor.

FIG. 19 shows a schematic diagram of a servo motor (7*a*) where said diagram is described in such a way that:

The positive of the servo motor (7*a*) communicates by means of wires with one of the contacts of the switch (26) and the contact 2 of the potentiometer (7*c*) and the positive of the battery (29).

The pulse of the servo motor (7*a*) communicates by means of cables with the PWM signal D1 of the controller card (7*b*).

The negative of the servo motor (7*a*) communicates by means of cables, with the negative of the battery (29), with the PWM signal D3 of the controller card 7*b*, the GND of said controller card (7*a*), the contact 1 of the potentiometer, one of the contacts of the resistor R1, and of the other contact of said resistance R1 is held by a cable that communicates to the other contact of the switch (26). Between the connection of the GND and the negative of the battery (29) a capacitor (C1) is connected in parallel. As one of the main advantages is known when connecting capacitors in parallel is that the total capacity value is increased.

The contact 3 of the potentiometer 7*c* is connected to the analog input A1 of the controller card 7*b*.

The servo motor (7*a*) works in such a way that:

When you press the switch (26), the capacitor (C1) has an accumulated energy that allows said energy to be released, giving it sufficient capacity to send a signal from the PWM D2 of the controller card (7*b*) to the pulse of the servo motor, allowing turn the pinion (7) of said motor servo (7*a*) at a 180° degree angle, in this process the capacitor (C1) is discharged, but recharged, and when the switch (26) is pressed again, said pinion (7) returns to its initial state. The voltage difference that is emitted in the circuit is regulated with the resistance R1 in such a way that said resistance R1 protects the elements connected to it.

The potentiometer is used to regulate and control the speed of the pinion (7) of the servo motor (7*a*). If we set the potentiometer (7*c*) to 0 resistance, the potentiometer 7*c* sends a signal through the analog input A1 to the motor servo (7*a*) causing the voltage of said motor servo (7*a*) to be the maximum you may have and the speed of the pinion (7) will be faster. If we increase the resistance of the potentiometer, said potentiometer sends a signal through the analog input A1 to the servo motor (7*a*) causing less voltage, and the speed of the pinion (7) will be slower. In this way we control the speed of the pinion (7).

The motor servo (7*a*) is held in the inner part of the main support (2) so that it cannot be moved and is also protected. The only part that protrudes outside is the pinion (7) from which the rotating base (10) will be held. Said motor servo (7*a*) would preferably be constructed of materials resistant to extreme temperatures, it would also be completely sealed to avoid any contact with any liquid.

The controller card (7*b*) is held in the inner part of the main support (2) in such a way that it cannot be moved. Said controller card (7*b*), being inside the support (2), is also protected.

Figure 20:
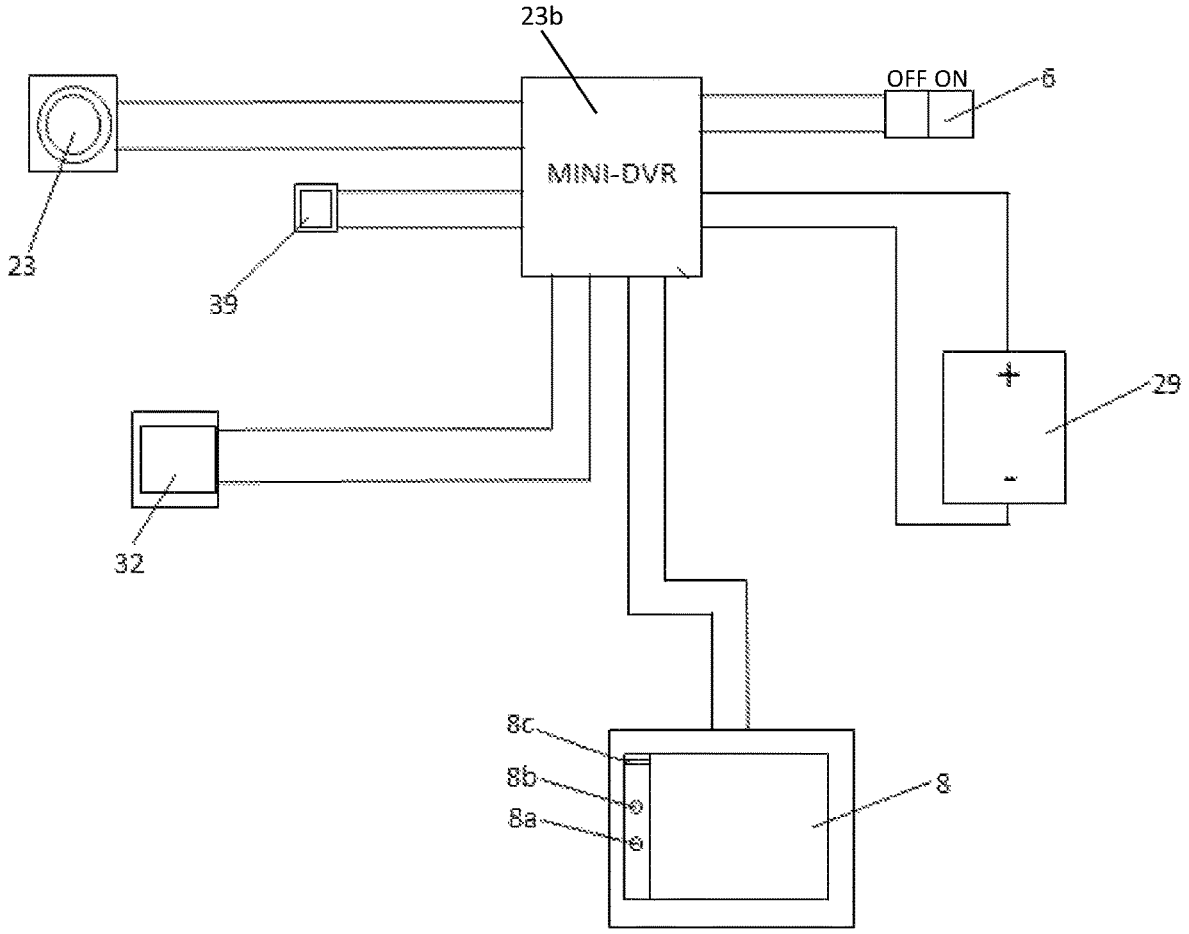
FIG. 20. Schematic diagram of a mini digital video recorder (DVR).

FIG. 20 shows a schematic diagram of a MINI DVR controller card 23*b*, which has a video camera (23), a microphone (39), a connector with a micro SD card input (32), a monitor that It can be LCD or LED (8) where said monitor (8) has a panel with several buttons that work as follows:

The switch (8*a*), when pressed, sends a signal to the MINI DVR controller card 23*b* giving it an order to create a capture of the area that the camera is focusing on (23), and at the same time that area capture instantly stores it in the micro SD.

The switch (8*b*) when pressed, sends a signal to the MINI DVR controller card 23*b* giving an order to activate the camera (23) in recording mode, allowing to record the area that said camera is focusing (23) and said recording is Instantly stores in the micro SD. Pressing the switch (8*b*) again deactivates the recording mode. Also said monitor (8) has a horn (8*c*) to be able to listen to the recording of what was stored in the micro SD.

The MINI DVR controller card 23*b* is connected from the battery (29) and said battery (29) supplies the power of said MINI DVR controller card 23*b* in conjunction with the camera (23), microphone (39), power connector the input of the micro SD (32) and monitor (8).

The MINI DVR controller card 23*b* also has a switch (6) that allows the MINI DVR controller card 23*b* to be switched off and on, so that when the switch (6) is turned off, it deactivates all components connected to the MINI DVR controller card 23*b* and if you put the switch on, it activates all the components connected to said MINI DVR controller card 23*b*.

The invention described in this way, it will be obvious that it can be developed in different ways. Such variations should not be considered as a deviation from the spirit and scope of the invention, and all are intended to be included within the scope of the following non-limiting claims.

The invention claimed is:

1. A flashlight comprising:

A main support (2), a servomotor (7*a*) that is set to be placed inside the main support (2), said servomotor (7*a*) comprises a pinion (7), a swivel base (10), configured to be held by the pinion (7), a plurality of supports (37) that are placed one for each end of the rotating base (10), a plurality of LEDS light lamps (14), comprising a plurality of gripping hooks (36), said plurality of LEDS light lamps (14) are placed one for each end of the plurality of supports (37), said plurality of LEDS light lamps (14) when placed on said plurality of brackets (37) the first of said plurality of LEDS light lamps (14) remains in the front position and the second of said plurality of LED light lamps (14) remains in the rear position of the lantern (1), said plurality of LED light lamps (14) also comprise flashing lights, a first controller card (7*b*) that serves to control the functions of the servomotor (7*a*), a second controller card or MINI DVR (23*b*) comprising a camera (23), a microphone (39), a connector with a micro SD card input (32) and a monitor (8), a rotating arm (9*a*) having two ends, the first end is connected to the rotating support (9), said rotating support (9) is connected to the main support (2) and the second end of said rotating arm (9*a*) is connects with the monitor (8), said rotating arm (9*a*) allows the monitor (8) to move or rotate and be placed under the main support (2) to protect itself, a third controller card (25*a*), configured to control the plurality of LED light lamps (14) that are in the front position of the lantern (1), a fourth controller card (25*e*), configured to control the plurality of LED light lamps (14) that are in the rear position of the lantern (1), a first switch (4) that is attached to the main support (2), which serves to turn on and off the plurality of LED light lamps (14) that are in the front position of the lantern (1), a second switch (4*a*) that is attached to the main support (2), which serves to turn on or off the flashing lights of the plurality of LED light lamps (14) that are in the front position of the lantern (1), a third switch (5) that is attached to the main support (2), which serves to turn on and off the plurality of LED light lamps (14) that are in the rear position of the lantern (1), a fourth switch (5*a*) that is attached to the main support (2), which serves to turn on or off the flashing lights of the plurality of LED light lamps (14) that are in the rear position of the lantern (1), a fifth switch (6) that is attached to the main support (2), which is used to turn on or off the controller card or MINI DVR (23*b*), a battery indicator (2*a*) that is attached to the main support (2), which is used to check the status of the battery (29), a potentiometer (7*c*), which is attached to the main support (2), which serves to control the energy of the servomotor (7*a*), a hook (3), which is attached to the main support (2), a belt (3*b*) that is attached to the hook (3), a handle (24) that is attached to the main support (2), said handle (24) serves to hold and manipulate the flashlight (1), a battery (29) that supplies the energy of the entire lantern (1), said battery (29) is configured to be housed inside the handle (24).

2. The swivel base (10) of claim 1 further comprises:

A plurality of female connectors (19) that is placed one at each end of the rotating base (10), the first of said plurality of female connectors (19) connects with the controller card (25*a*) and the second of said plurality of female connectors (19) connects with the controller card (25*e*).

3. The plurality of LED light lamps (14) of claim 1 further comprises:

A plurality of LED light indicators (16), which serve to indicate which light is active of the plurality of LED light lamps (14), a plurality of female connectors (19), which is placed one in each plurality of LED light lamps (14), a plurality of cables (13*a*) comprising a plurality of male connectors (13) one at each end of said plurality of cables (13*a*), the first of said male connectors (13) is configured to connect to the first of the connectors female (19) of the rotating base (10), the second of said male connectors (13) is configured to connect to the first of said female connectors (19) of the plurality of LED light lamps (14), the third of said male connectors (13) is configured to connect to the second of the female connectors (19) of the swivel base (10) and the fourth of said male connectors (13) is configured to connect to the second of the female connectors of the plurality of LED light lamps (14), said plurality of wires (13*a*) serve to send current and control the lights of the plurality of LED light lamps (14).

4. The handle (24) of claim 1 further comprises:

A panel (25) comprising a plurality of switches that when pressed serve to change the colors of the plurality of LEDS light lamps (14) of the lantern (1) and a switch or trigger (26), said panel (25) is fixed on one side of the handle (24) and has a slight inclination in such a way that the thumb of the user can reach the switches of said panel (25) and the index finger of the user of the same hand where said finger is located The user's thumb can reach the switch (26), said switch (26) when pressed allows the swivel base (10) to rotate.

* * * * *